US006651257B2

(12) United States Patent
Smith

(10) Patent No.: US 6,651,257 B2
(45) Date of Patent: Nov. 25, 2003

(54) GAITER-SOCK COMBINATION

(76) Inventor: Lane F. Smith, 2689 Bridger Blvd., Sandy, UT (US) 84093

( * ) Notice: Subject to any disclaimer, the term of this patent is extended or adjusted under 35 U.S.C. 154(b) by 0 days.

(21) Appl. No.: 10/138,000

(22) Filed: May 3, 2002

(65) Prior Publication Data

US 2002/0120977 A1 Sep. 5, 2002

Related U.S. Application Data

(63) Continuation of application No. 09/565,863, filed on May 5, 2000, now Pat. No. 6,381,756.

(60) Provisional application No. 60/132,783, filed on May 6, 1999.

(51) Int. Cl.[7] ..... A41B 11/00

(52) U.S. Cl. ..... 2/239; 2/242

(58) Field of Search ..... 2/239, 240, 241, 2/242, 455, 22, 23, 60, 61, 231, 232, 233; 36/2 R, 4, 10

(56) References Cited

U.S. PATENT DOCUMENTS

| | | | | |
|---|---|---|---|---|
| 1,435,047 | A | 11/1922 | Blum | 2/61 |
| 1,610,378 | A | 12/1926 | Hogan | 36/2 A |
| 1,648,758 | A | 11/1927 | Conrad | 2/242 |
| 1,652,750 | A | 12/1927 | Wohlgemuth | 2/227 |
| 1,708,810 | A | 4/1929 | Vrabek | 2/242 |
| 1,746,485 | A | 2/1930 | Lynk | 36/2 R |
| 1,894,866 | A | 1/1933 | Heelan | 36/2 R |
| 2,429,625 | A | 10/1947 | Horn | 2/61 |
| 2,450,968 | A | 10/1948 | Knubel | 36/70 R |
| 2,719,977 | A | 10/1955 | Fields | 2/61 |
| 2,741,770 | A | 4/1956 | Tannen | 2/61 |
| 3,008,146 | A | 11/1961 | Francone | 2/61 |
| 3,083,373 | A | 4/1963 | Rizzotto | 2/270 |
| 3,477,147 | A | 11/1969 | Bauer | 36/2 |
| 3,605,122 | A | 9/1971 | Myers | 2/239 |
| 3,633,290 | A | 1/1972 | Rubeling | 36/2 R |
| 4,001,953 | A | 1/1977 | Fugere et al. | 36/2 |
| 4,034,580 | A | 7/1977 | Holder | 66/172 |
| 4,035,860 | A | 7/1977 | Fugere et al. | 12/142 |
| 4,064,641 | A | 12/1977 | Levine | 36/1.5 |
| D249,398 | S | 9/1978 | Stewart | D2/275 |
| 4,169,324 | A | 10/1979 | Gibbs | 36/83 |
| 4,373,215 | A | 2/1983 | Guigley | 2/239 |

(List continued on next page.)

OTHER PUBLICATIONS

Gaiters, Backpacking, One Step at a Time, Fourth Vintage Books Edition, Apr. 1986, pp. 152.

Take a Bite out of Stream Crossings; Outdoor Research Crocodiles, Backpacker Magazine, Apr. 1999, pp. 89.

Gaiters, Campmor Catalog, Late Spring 1999, pp. 148.

All–season gaiters keep world out of your boots, http://www.seattlepi.com/getaways/071698/gear16.html, Jun. 6, 1999, pp. 1–3.

Flex Tex Gaiter, http://www.fogdog.com/cedrolD/ssd1539214400111/, Jun. 6,1999, pp. 1–2.

Treklite Gaiters, http://www.treklite.com/products/0–stuf/gaiters.htm, Jun. 6, 1999, pp. 1–3.

Rocky Mountain High, http://www.moosejawonline.com/orrockymnthigh.html, Jun. 6, 1999, pp. 1–2.

SockTop Gaiter, http://www.socktopgaiter.com//about.htm, Jun. 6, 1999, pp. 1–6.

*Primary Examiner*—John J. Calvert
*Assistant Examiner*—Alissa L. Hoey
(74) *Attorney, Agent, or Firm*—Pate Pierce & Baird

(57) ABSTRACT

A combination of a gaiter member (24) attached (26) to a sock member (22) in various embodiments creates a gaiter-sock combination, which simply and efficiently provides barrier protection to a lower body extremity. The gaiter portion (24) may protect a sock portion (22), or the inside of a boot or shoe (32), or various combinations of them, from debris, insects, arachnids, thorns, burrs, and the like.

20 Claims, 8 Drawing Sheets

U.S. PATENT DOCUMENTS

| | | | | | |
|---|---|---|---|---|---|
| 4,393,522 | A | | 7/1983 | Calabrese | 2/336 |
| D273,633 | S | | 5/1984 | Drum | D2/334 |
| 4,502,158 | A | | 3/1985 | Mouri et al. | 2/240 |
| 4,503,566 | A | | 3/1985 | Wheeler | 2/22 |
| 4,542,597 | A | | 9/1985 | Baptista et al. | 36/2 R |
| 4,586,271 | A | | 5/1986 | Maleyko et al. | 36/1.5 |
| 4,665,562 | A | | 5/1987 | Winer | 2/22 |
| 4,665,633 | A | | 5/1987 | Edgerton | 36/2 |
| 4,702,091 | A | | 10/1987 | Good et al. | 66/171 |
| 4,748,749 | A | * | 6/1988 | Colvard | 36/2 R |
| 4,809,447 | A | | 3/1989 | Pacanowsky et al. | 36/9 R |
| 4,856,207 | A | | 8/1989 | Datson | 36/2 R |
| 4,896,437 | A | | 1/1990 | Johnson | 36/1.5 |
| 5,070,544 | A | | 12/1991 | Aliberti et al. | 2/170 |
| 5,165,182 | A | | 11/1992 | Michael | 36/1.5 |
| 5,249,310 | A | | 10/1993 | Forte | 2/239 |
| D345,251 | S | | 3/1994 | Pounds | D2/980 |
| 5,325,541 | A | | 7/1994 | Willard | 2/239 |
| 5,381,557 | A | * | 1/1995 | Luria et al. | 2/16 |
| D356,662 | S | | 3/1995 | Baade | D2/901 |
| D359,843 | S | | 7/1995 | Jones | D2/980 |
| D362,951 | S | | 10/1995 | Graves | D2/901 |
| D362,957 | S | | 10/1995 | Lindaman | D2/993 |
| 5,491,911 | A | | 2/1996 | Chen | 36/89 |
| D369,455 | S | | 5/1996 | Halvorson | D2/901 |
| D371,452 | S | | 7/1996 | Graves | D2/901 |
| 5,613,250 | A | | 3/1997 | Bell | 2/242 |
| 5,642,573 | A | | 7/1997 | Brown | 36/2 R |
| 5,815,948 | A | | 10/1998 | Dzielak | 36/2 R |
| 6,047,403 | A | | 4/2000 | Juozaitis | 2/61 |
| 6,131,194 | A | | 10/2000 | Ardura Gonzalez | 2/22 |
| 6,381,756 | B1 | | 5/2002 | Smith | 2/242 |

* cited by examiner

GAITER-SOCK COMBINATION

RELATED APPLICATION

This application is a continuation of Ser. No. 09/565,863 filed May 5, 2000 now U.S. Pat. No. 6,381,756; which claims priority to U S. provisional patent application serial No. 60/132,783 entitled GAITER-SOCK COMBINATION, and filed on May 6, 1999.

BACKGROUND

1. The Field of the Invention

This invention relates to socks and gaiters and, more particularly, to socks and gaiters that are used as barriers for protection of the lower extremities, boots (shoes), socks, or any combination of these 2. The Background Art Sandals, socks, and pants were invented to warm and protect humans' lower extremities. When these proved inadequate at times, others invented and improved the shoe and boot. But anyone who walks very far off paved roads soon discovers these protectors still have their shortcomings. Thorns and thistles penetrate or lodge in the socks and the boot (shoe) linings Rocks and other debris slip in between the boot (shoe) and sock to discomfort. Insects and arachnids such as spiders and ticks crawl up the sock to bite the exposed skin and perhaps infect Plant toxins like poison ivy can still afflict the legs of the wearer of socks and boots (shoes) Snow and water soak socks and the inside of boots (shoes), even when the boot (shoe) exteriors are waterproofed.

Attempts to overcome the deficiencies of pants, socks, and boots (shoes) as barrier protectors led to the development of a class of inventions commonly called gaiters A dictionary describes gaiters in part as "cloth or leather leg coverings reaching from the instep to above the ankle." Another dictionary describes a gaiter in part as "an outer covering of the leg below the knee or for the ankle, made usually of cloth or leather, for outdoor use " A functional gaiter, as opposed to a decorative gaiter, serves in some way beyond the boot (shoe) or sock or pant legs as additional barrier protection for the lower extremity. Gaiters help prevent inconveniences and discomforts like thistles, burrs or the like in the sock, or stones in the shoe or boot. More importantly, good gaiter designs can protect the lower extremities from trauma, bug bites, infections, plant toxins, cold, snow, and water A review of the U.S. patents issued, hiking and walking gear offered for sale in the USA, and the long memories of a number of older, experienced hikers demonstrate that previous gaiters have a few common elements. Typically, gaiter attachments have been cumbersome and time consuming to use. The more effective barrier protection gaiter inventions have been large, heavy, hot, expensive, and therefore used sparingly. Prior simple gaiter inventions are difficult to attach adequately, stay in place poorly, and commonly break down as effective barrier protection "The extendible boot" disclosed in U.S. Pat. No. 4,586,271 to Maleyko, et al, issued May 6, 1986, requires the purchaser to choose that model only for protection and hence cannot be used universally with other boots. Brown's "Shoe with integral storable gaiter," U.S. Pat. No. 5,642,573, issued Jul. 1, 1997 also has the limitation of not being usable as a gaiter with any other boot. Chen discloses a "fastening means to secure a gaiter to a shoe" (U.S. Pat. No. 5,491,911, issued Feb. 20, 1996) It will only fit shoes "having a pair of studs integrally formed at the rear" of the shoe. Again, this is a complex and non-universal (any shoe) design "Shoe covering and gaiter," U.S. Pat. No. 3,477,147, issued to Bauer on Nov. 11, 1969, discloses a very complex, apparently heavy gaiter that attaches to the shoe Datson's "Shoe and gaiter," U.S. Pat. No. 4,856,207, issued Aug. 15, 1989, requires the gaiter to be "permanently affixed" to the boot. Fugere, et al, has several similar patents (U.S. Pat. Nos. 4,001,953, issued Jan. 11, 1997 and 4,035,860, issued Jul. 19, 1997), in which each includes "an energy-absorbing pad" The description suggests substantial weight for protection from substantial trauma. Both inventions require the gaiter to be worn over the instep Johnson discloses an "insulated boot and gaiter combination" (U.S. Pat. No. 4,896,437, issued Jan. 30, 1990). This requires a special "gaiter" which attaches to a special "boot" With at least two layers on the gaiter, three snaps, one zipper, one drawstring, one clip, one elastic strap, one other strap, and hook-and-loop fasteners, it is hardly simple or convenient. Other devices such as Winer's (U.S. Pat. No. 4,665,562, issued May 19, 1987) describe fairly typical gaiters with various ways of fastening the gaiter around the lower extremity. Again these designs in general are elaborate, heavy, and warm.

Calabrese discloses an "ankle gaiter with boot stirrup" (U.S. Pat. No. 4,393,522, issued Jul. 19, 1983). This has a "band" around the ankle and a "stirrup" over the instep. It holds "the bottom trousers or pant legs in place to allow for ease of insertion in a sock " It obviously would have difficulty containing any but very long pant legs. The "stirrup" proves a nuisance and debris can still get into the boot.

In U.S. Pat. No. 3,633,290, issued Jan. 11, 1985, Rubeling discloses his "Snow blocks." Like other extant designs, it is simply a "tube" or cuff that wraps around the junction of a boot top and a "trouser". These unattached designs do not stay in place well The "double sock construction" of Guigley (U.S. Pat. No. 4,373,215, issued Jul. 15, 1983) has nothing to do with gaiter protection, and merely makes the inner sock shorter to prevent "bunching of the toe of the double sock." Pacanowsky discloses a "waterproof breathable sock" (U.S. Pat. No. 4,809,447, issued Mar. 7, 1989), taking waterproof breathable material technology and applying it to socks. His design can keep the foot dry, but not the inner lining of the boot. Also, debris can still get into the boot, and bugs can enter the pant leg. Willard did a spinoff on the foregoing sock. He created a "waterproof oversock" (U.S. Pat. No. 5,325,541, issued Jul. 5, 1994) to be worn over the wearer's choice of under socks. It has the same inherent limitations of the previous sock invention Holder discloses a "boot sock with stay-up cuff and method" (U.S. Pat. No. 4,034,580, issued Jul. 12, 1977), described as an "integrally knit" design to allow one portion to extend upward around the leg. The patent states that the sock only "covers the upper edge of the boot" But since boot heights vary greatly, the inventor acknowledged having to make socks with the cuffs at different levels in order to be useful at all. This design does not extend down and cover the sides of the boot. Between the design specifications of "knit" material and not covering the side of the boot, this design doesn't protect against bugs, snow, water, or thistles, and the sock could easily dislodge enough for debris to enter between the sock and boot.

Baptista et al (U.S. Pat. No. 4,542,597, issued Sep. 24, 1985) for a "snow shield foot and leg insulator" discloses an "inner cloth tube for engagement with a foot and leg and an outer cloth tube." He specifies that the "said inner cloth tube is made of 100% nylon shell having a core of 100% polyester filler", a bulky wrapping indeed, for the confines of a foot within the body of a boot. Since he claims the "inner cloth tube is for engagement with a foot and a leg", there is an inferior opening on the tube, which inferiorly exposes the end of the foot, or the foot per se, to the boot itself, unless a sock is worn under the "tube". The tube can potentially creep up the ankle, as there is no cap or closed end to prevent such upward migration. Further, this invention as its name implies ("snow shield foot and leg insulator") is limited to cold and/or snow conditions, and would be most uncomfortable with its four layers (sock, insulated inner tube, boot and outer tube) in hotter climates. The inventors consistently refer to the portion which covers the foot and leg as a "tube" and the illustration shows only a "tube".

Judging by the continued application for patents, and patents issued for gaiters, there has been a perceived need for improvements. The ideal invention would be simple, effective, easy to use, lightweight, versatile, inexpensive, and dependable as a barrier protection. Such an invention should conceivably encourage far more gaiter use and hence, more and better protection for the lower extremities of humans.

BRIEF SUMMARY AND OBJECTS OF THE INVENTION

In view of the foregoing, it is a primary object of the present invention to provide an improved gaiter integrated or readily integrable with a sock for several advantageous results Principal objects and advantages of the gaiter sock invention include being simple, stable, quick and easy to use, small, lightweight, and relatively inexpensive, effective barrier protection. In some embodiments, other objects and advantages include being cooler and more breathable than other presently available inventions, while still allowing other embodiments for warmth. In its various embodiments, the common objects and advantages of the gaiter sock invention are barrier protection against a wide variety of harmful or annoying agents. These include snow, water, rocks, sand, dirt, thistles, plant toxins, insecta, arachnida, and infectious agents, etc. Further objects and advantages of the gaiter sock invention will become apparent from a consideration of the drawings and ensuing description, attention being called to the fact that the drawings are illustrative only, and that changes may be made in the specific constructions illustrated.

Consistent with the foregoing objects, and in accordance with the invention as embodied and broadly described herein, an apparatus and method are disclosed, in suitable detail to enable one of ordinary skill in the art to make and use the invention. In certain embodiments an apparatus and method in accordance with the present invention may include a sock, a gaiter secured thereto, and constrictions for.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1A through 5C, is not intended to limit the scope of the invention. The scope of the invention is as broad as claimed herein. The illustrations are merely representative of certain, presently preferred embodiments of the invention. Those presently preferred embodiments of the invention will be best understood by reference to the drawings, wherein like parts are designated by like numerals throughout.

Those of ordinary skill in the art will, of course, appreciate that various modifications to the details of the Figures may easily be made without departing from the essential characteristics of the invention. Thus, the following description of the Figures is intended only by way of example, and simply illustrates certain presently preferred embodiments consistent with the invention as claimed.

Figure 1A:
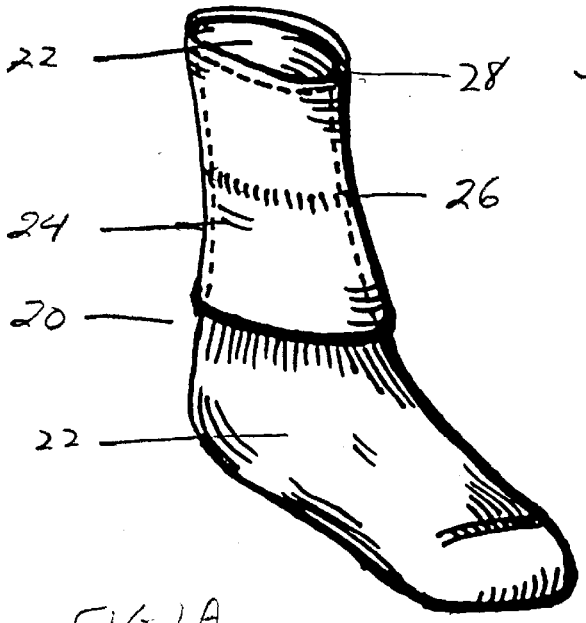
FIG. 1A is a perspective view one embodiment of the gaiter-sock combination.

A gaiter sock synthesizes sock design with gaiter design to create a new form of barrier protection for a lower body extremity, boot (shoe), sock, or combination of these In FIG. 1A, a sock member 22 may be made of any available sock material such as wool, acrylic, or polyester. A gaiter member 24 can likewise be made of any natural or synthetic clothing material such as nylon or polyester. Gaiter material can be treated to render it waterproof and/or breathable. The gaiter 24 covers and encloses the upper end of the sock 22 The sock and gaiter members are joined or fastened together at a primary attachment 26

Figure 1B:
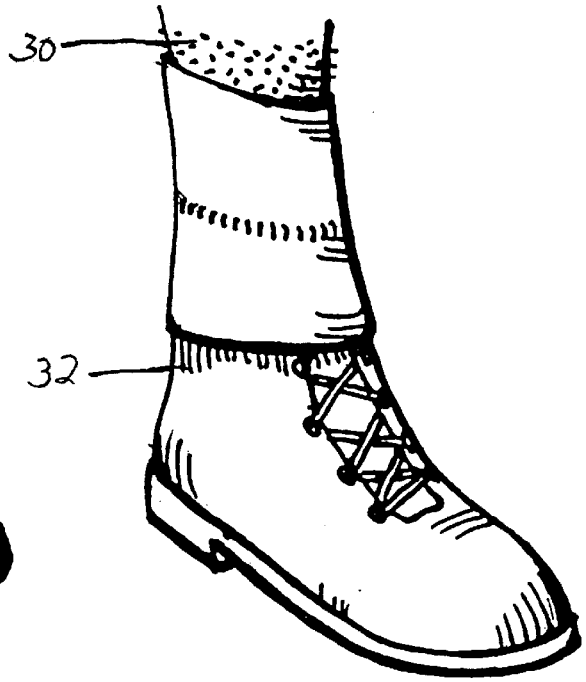
FIG. 1B is a perspective view of the apparatus of FIG. 1A as it appears when worn appropriately with a boot, in one embodiment.
Figure 1C:
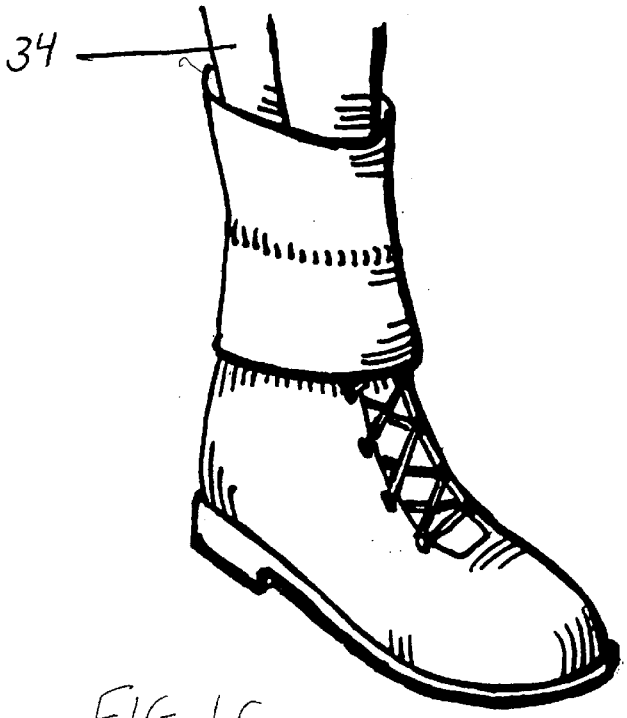
FIG. 1C is a perspective view of the apparatus of FIG. 1A as it appears when worn appropriately with a boot, in an alternative embodiment.

There also can be a variable attachment 28 of the gaiter member to the sock member. The method of attachment(s) may be by any method now known or discovered in the future, such as sewing, snaps, hook and loop fasteners, drawstrings, buttons, adhesives, elastics, etc. In order to enclose the boot top, or the leg, or the pant leg bottom, the top and bottom circumferences, or edges, of the gaiters 24 in FIGS. 1A–1E can be designed in various ways. One may use elasticized nylon, hook and loop fasteners, drawstrings, and any other suitable material or method FIG. 1B shows an embodiment of a gaiter sock as worn with a boot (shoe) 32 on a lower extremity or leg 30. The bottom (or inferior) portion of the gaiter 24 covers the upper portion of the boot (shoe) 32. FIG. 1C shows how, in a variation of this main embodiment, the gaiter 24 not only covers the boot 32 and sock 22, but can, in its upper portion, also enclose, hold, and cover a lower pant leg 34. Thus the upper portion of the gaiter 24 can be worn inside or outside the pant leg 34.

Figure 1D:
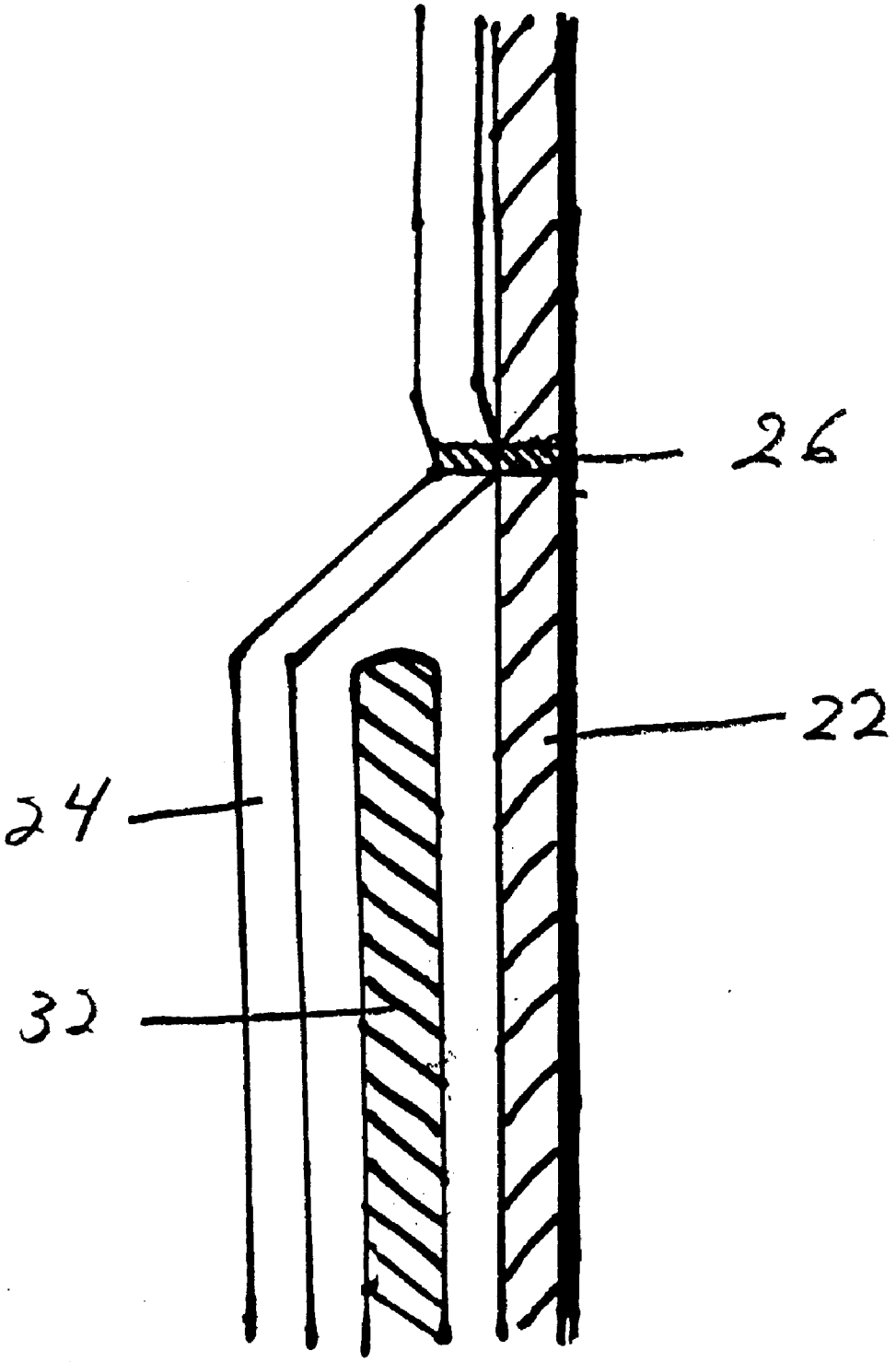
FIG. 1D is a cross-sectional view of the apparatus of FIG. 1B where the gaiter member and the sock member of the invention are primarily attached together.
Figure 1E:
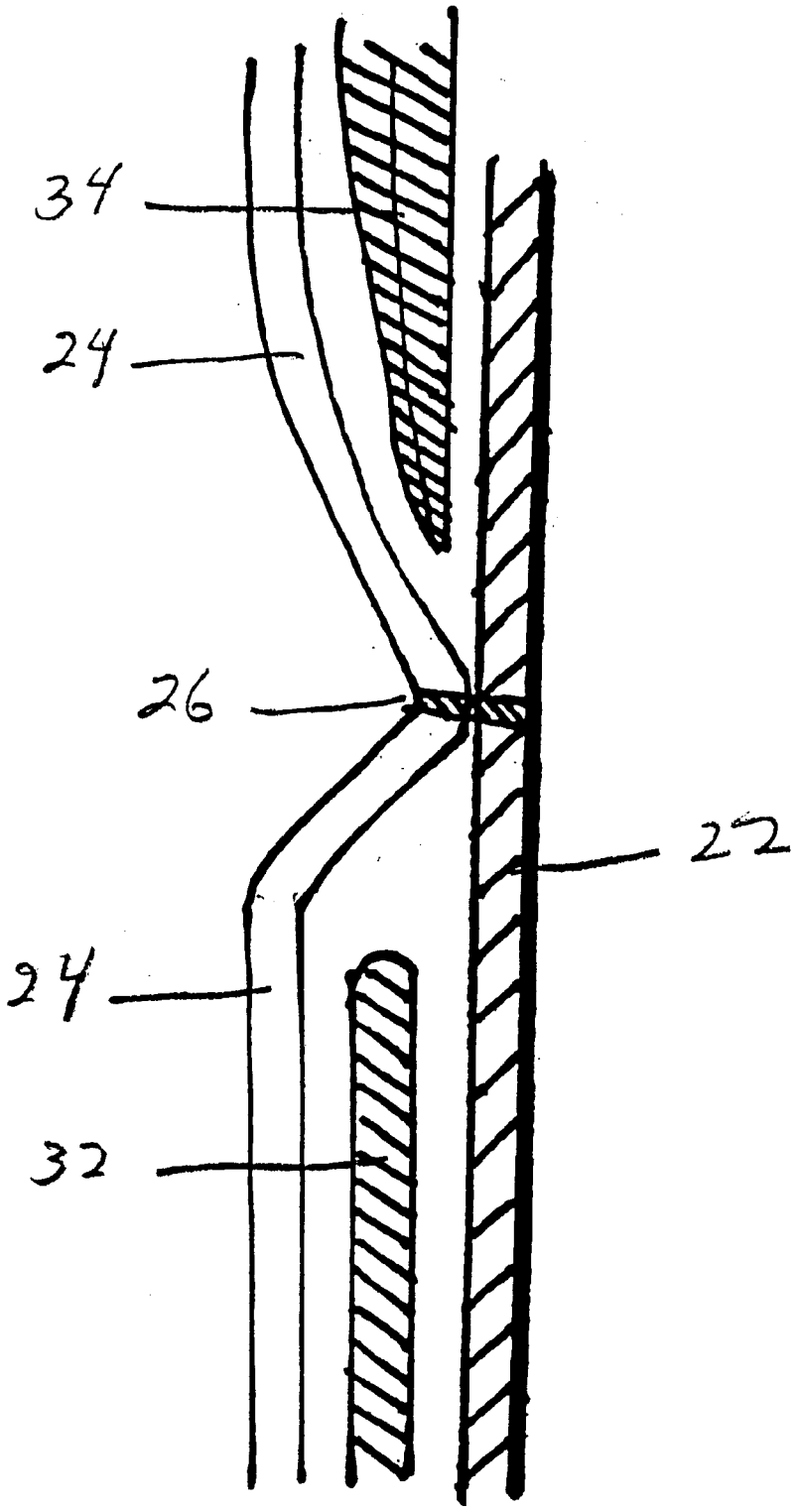
FIG. 1E is a cross-sectional view of the apparatus of FIG. 1C where the gaiter member and the sock member are primarily attached together.

FIG. 1D shows a cross-section of the device of FIG. 1B while FIG. 1E shows a cross-section of the device of FIG. 1C Both cross-sections are taken at approximately the level of the top of the boot 32 and the primary attachment 26 of the gaiter and sock members. In FIG. 1D the gaiter 24 top is worn inside the pant leg (not shown) In FIG. 1E, the gaiter 24 top covers and encloses the pant leg 34 In both cross-sectional views (FIG. 1D and FIG. 1E), the lower portion of the gaiter 24 covers the boots 32.

FIG. 1B illustrates the gaiter sock invention as worn on the foot like a conventional sock. The boot 32 is worn over the lower sock 22 portion, but underneath the lower or inferior gaiter 24 portion. The pant leg (not shown) may be worn over the leg 30 and gaiter 24 The gaiter member 24 of the invention may be held primarily in place by the attachment 26 of the gaiter to the sock member 22, but also at the variable attachment 28 The sock member 22, in turn, is held in place by the boot 32. Also, the attachment 26 of the gaiter member 24 to the sock member 22 keeps the sock from creeping down into the boot 32 as they together bridge the boot 32 top and are thus essentially held in place. Cross-sections in FIGS. 1D and 1E illustrate the bridge over the boot 32 top.

FIG. 1C illustrates an embodiment wherein the upper portion of the gaiter 24 is open at the top and hence able to enclose or hold the pant leg 34. There is only the primary attachment 26 of the sock member 22 to the gaiter member 24. In other respects, the features illustrated in FIGS. 1B and 1C are similar. The embodiment of FIG. 1C completely encloses the lower pant leg, sock and upper boot, giving additional barrier protection against such things as bugs crawling up the leg. No skin of the lower extremity is exposed.

For hotter climates, light and breathable materials may be chosen, like stretch nylon for heat and moisture dissipation. For snowy or wet climates, waterproof breathable coated fabrics for protection from snow and water may be selected. For cold climates, heavier materials may be used. When thistle, burr, or thorn protection is needed, the fabric choice may be one with a dense weave. As clearly demonstrated in the foregoing description, many suitable materials and closure methods may be used in any of the illustrated embodiments to make the gaiter sock most reliable and easy to use. Furthermore, any of the above description and operation applies in general to the remaining descriptions and operations, as listed following.

Figure 2A:
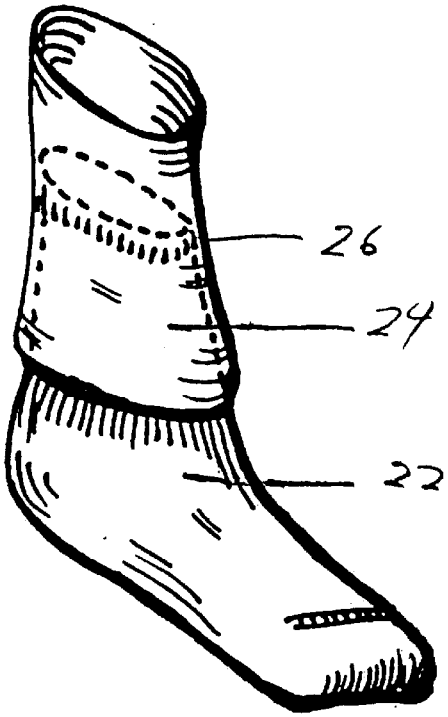
FIG. 2A is a perspective view of another embodiment of an apparatus in accordance with the invention.
Figure 2B:
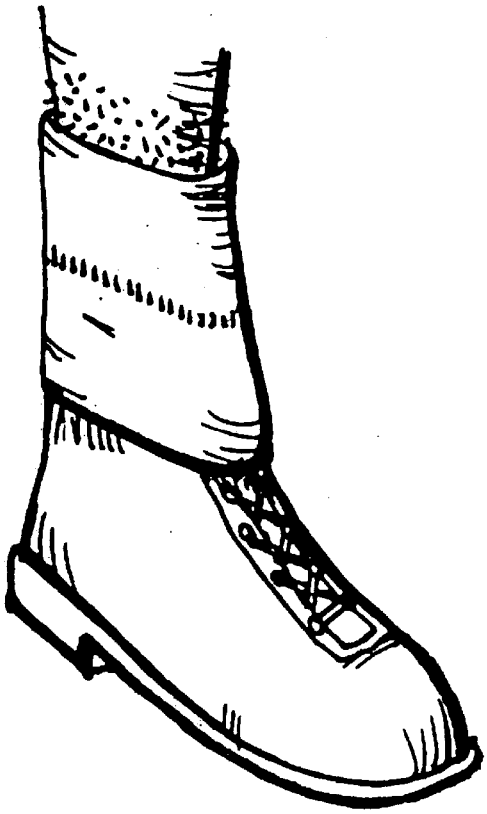
FIG. 2B is a perspective view of the apparatus of FIG. 2A as it appears when worn appropriately with a boot.
Figure 2C:
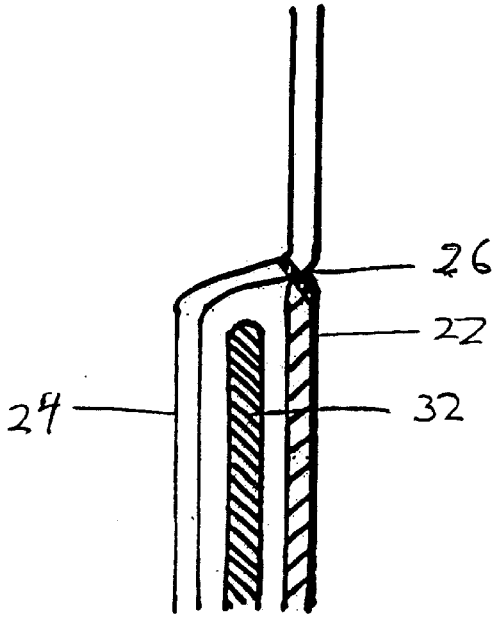
FIG. 2C is a cross-sectional view of the apparatus of FIG. 2B, where the gaiter member and the sock member are primarily attached together.

FIGS. 2A–2C illustrate a second embodiment of the gaiter sock. This embodiment differs from the embodiment shown in FIGS. 1A–1E by the sock member 22 ending some distance below the top of the gaiter member 24. This embodiment allows a single layer of material to cover the leg 30 above the top of the boot or shoe 32 In operation, this can provide barrier protection with minimal heat and moisture retention. An example is the use of a very breathable, thin gaiter 24 portion for hot climate use.

Figure 3A:
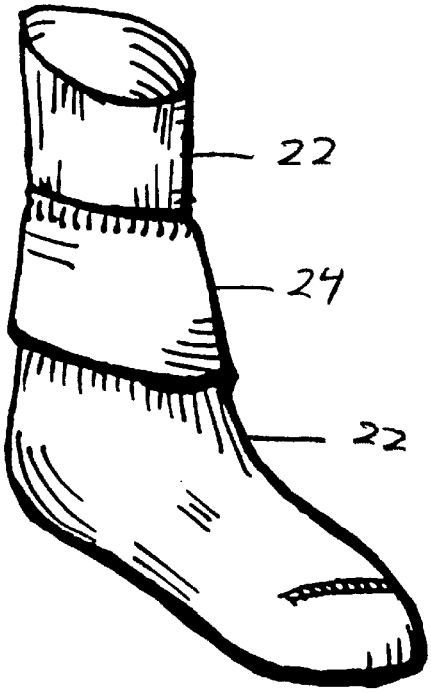
FIG. 3A is a perspective view of another embodiment of an apparatus in accordance with the invention.
Figure 3B:
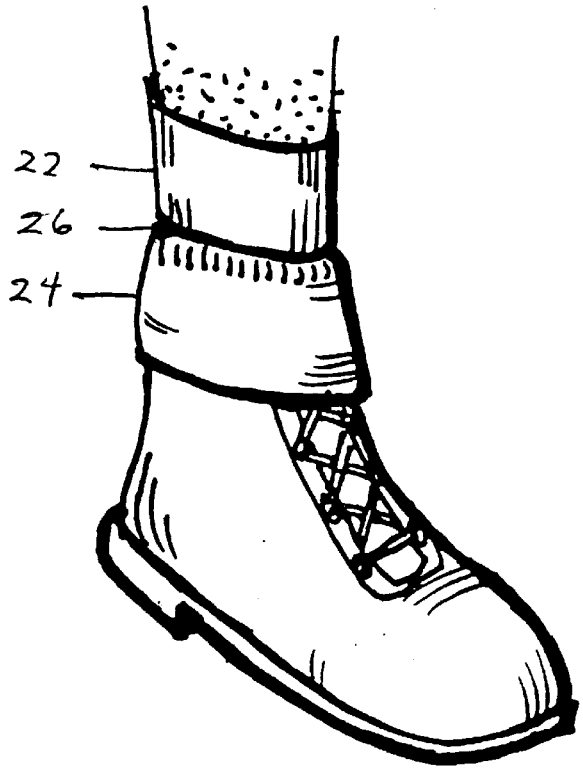
FIG. 3B is a perspective view of the apparatus of FIG. 3A as it appears when worn appropriately with a boot.
Figure 3C:
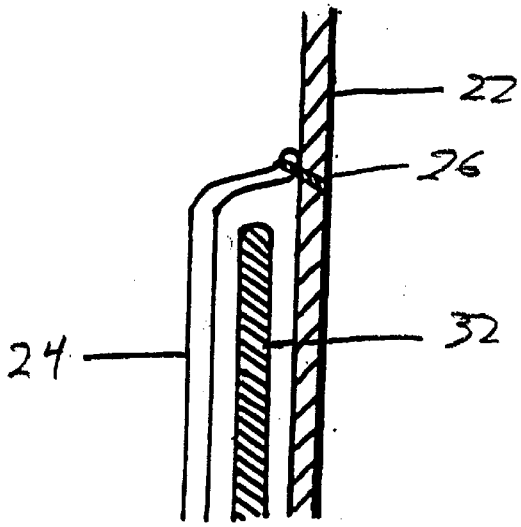
FIG. 3C is a cross-section view of the apparatus of FIG. 3B, where the gaiter member and the sock member of the invention are primarily attached together.
Figure 4A:
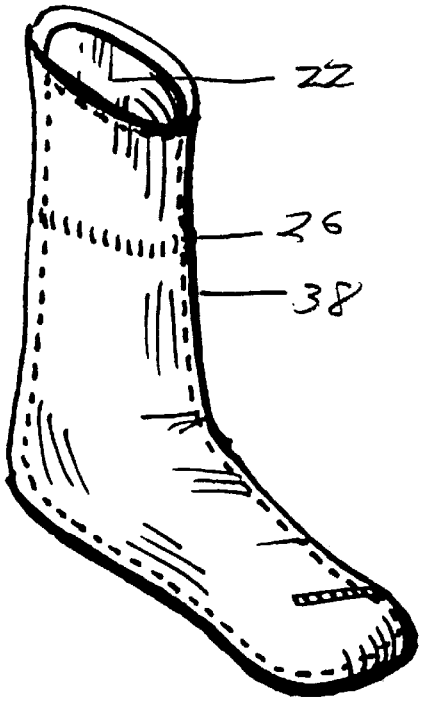
FIG. 4A is a perspective view of another embodiment of an apparatus in accordance with the invention.
Figure 4B:
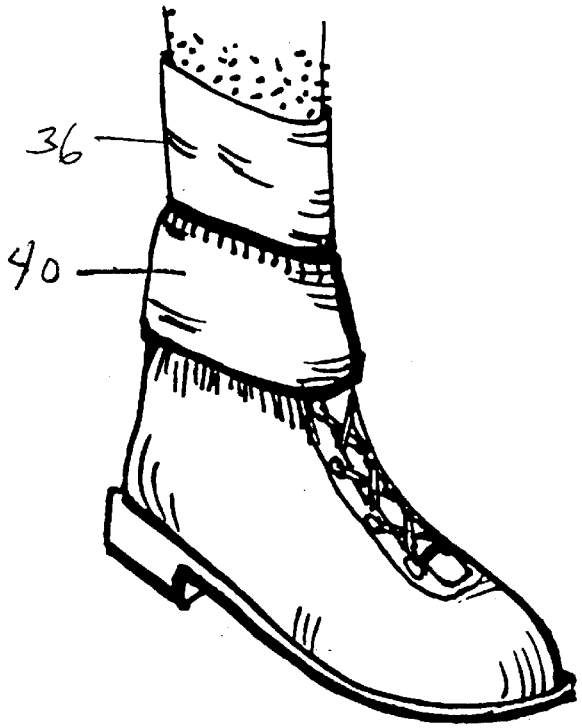
FIG. 4B is a perspective view of the apparatus of FIG. 4A as it appears when worn appropriately with a boot.
Figure 4C:
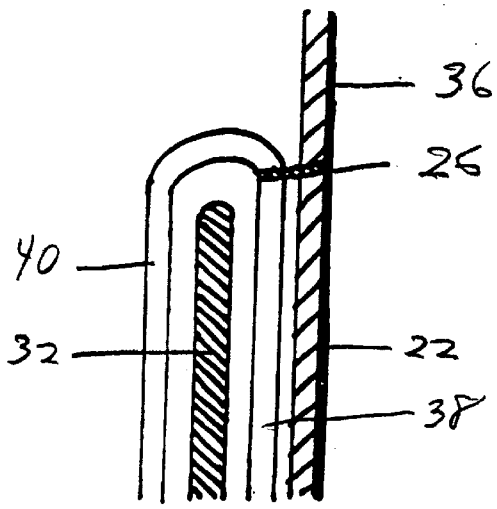
FIG. 4C is a cross-sectional view of the apparatus of FIG. 4B, where the gaiter member and the sock member are primarily attached together.

FIGS. 3A–3C illustrate a third embodiment of the gaiter sock. This embodiment differs from the embodiment shown in FIGS. 1A–1E by the gaiter member 24 ending just above the boot 32, while the sock 22 member continues up the leg 30. In operation, like the second embodiment, this allows a single material layer to cover the leg. So this third embodiment also provides barrier protection with minimal heat and moisture retention FIGS. 4A–4C illustrate yet a fourth embodiment of the gaiter sock. This embodiment differs significantly from the main embodiment illustrated in FIGS. 1A–1E. FIG. 4A shows the basic design of a sock 22 within a second sock 22 The two "socks" are primarily attached together 26, at a level that will be above the top of the boot or shoe 32 (not shown) When worn with a boot (see FIG. 4B), the top portion of the outer sock is folded down over the boot, thus forming a "gaiter" 24.

Figure 5A:
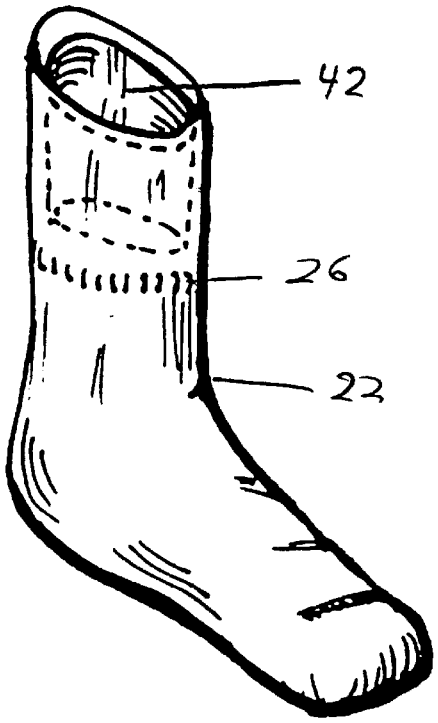
FIG. 5A is a perspective view of an alternative embodiment of a gaiter sock combination.
Figure 5B:
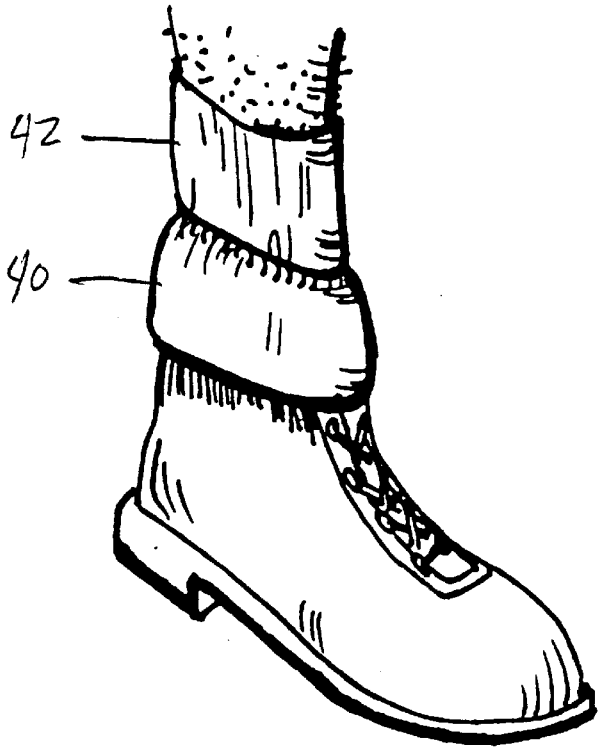
FIG. 5B is a perspective view of the apparatus of FIG. 5A as it appears when worn appropriately with a boot.
Figure 5C:
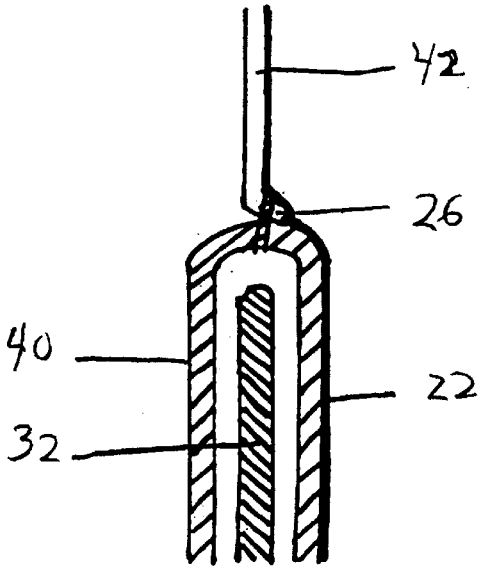
FIG. 5C is a cross-sectional view of the embodiment of FIG. 5B where the gaiter member and the sock member of the invention are primarily attached together.
Figure 6A:
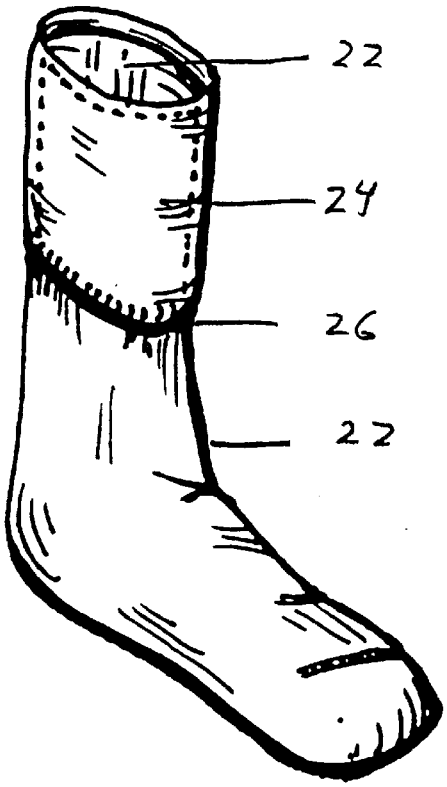
FIG. 6A is a perspective view of another alternative embodiment of an apparatus in accordance with the invention.
Figure 6B:
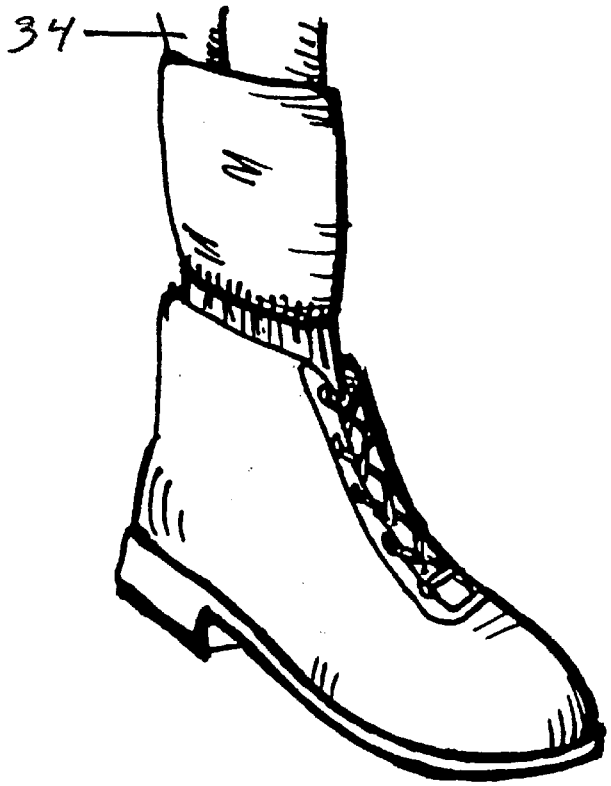
FIG. 6B is a perspective view of the apparatus of FIG. 6A as it appears when worn appropriately with a boot.
Figure 6C:
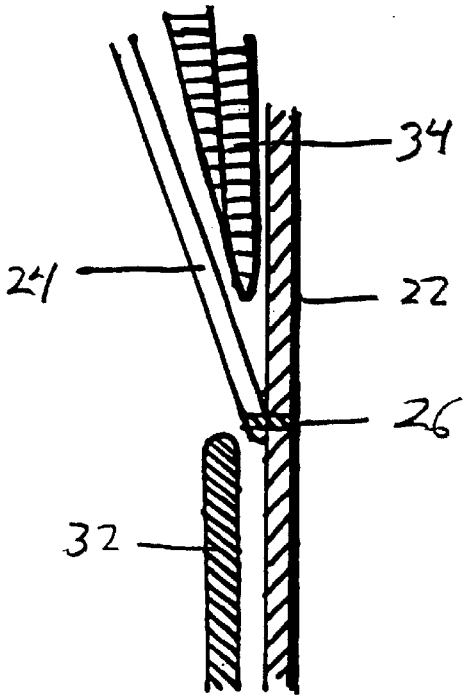
FIG. 6C is a cross-sectional view of the apparatus of FIG. 6B where the gaiter member and the sock member of the invention are primarily attached together

In operation this embodiment allows the wearer to wear the top of the outer sock as a gaiter (FIG. 4B) in the field, or up on the leg (not shown) as in FIG. 4A, when not needed as barrier protection, thus hiding the gaiter function or appearance. It should be noted here that veteran hikers often wear two socks, an inner liner to wick moisture away from the boot, and to reduce friction, and an outer sock for warmth or ventilation, and/or for cushioning. This embodiment of the gaiter sock allows double layering while adding the advantages of an effective lightweight, simple gaiter FIGS. 5A–5C illustrates a fifth embodiment of the gaiter sock invention. This embodiment differs significantly from the embodiment illustrated in FIGS. 1A–1E. FIG. 5A shows a sock 22 appearing like any typical sock on the outside. At a level above the intended boot or shoe height, there is an inner tube or cylinder of material 42 attached to the outer sock 22 at the primary attachment 26. When worn on the boot (FIG. 5B), the outer top portion of the gaiter sock is folded down over the boot, thus functioning as a "gaiter" 40 The inner upper material functions as a sock 42 and a gaiter around the leg 30. In operation this embodiment, like the second, third, and fourth embodiments, covers the leg 30 with only one layer of the gaiter sock. Again, this allows for good heat and moisture dissipation. Like the fourth embodiment, the "gaiter" 40 portion can be worn up off the shoe and onto the leg for the self conscious wearer, when not in the field, thus hiding its "gaiter" portion FIGS. 6A–6C illustrate a sixth embodiment of the gaiter sock invention. This embodiment differs from the main embodiment shown in FIGS. 1A–1E by not having a gaiter portion that covers the boot 32 Instead, a gaiter member 24 covers only the leg 30 and encloses, holds and covers the pant leg 34. In operation this embodiment may not prevent debris, etc from entering the boot but does prevent bugs such as ticks from crawling up the sock onto the leg. It also leaves no portion of the foot or leg exposed.

From the above discussion, it will be appreciated that the present invention provides a sock member 22, gaiter member 24, with a primary attachment 26 of sock 22 and gaiter members 24. The apparatus may provide variable attachment(s) 28 of sock 22 and gaiter 24 members with respect to a leg 30, boot or shoe 32, or pant leg 34. The primary attachment 26 may or may not coincide with the top 36 of a sock member 22, or an outer sock 38 In certain embodiments, upper and outer material 40 functioning as a "gaiter" may be a contiguous and/or continuous portion with upper inner material 42 functioning as a "sock "

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope

What is claimed and desired to be secured by United States Letters Patent is:

1. An apparatus comprising:

a stocking member for protecting a foot of a user;

a gaiter member securable to the stocking;

a securement member connecting the gaiter member to the stocking member;

the stocking member, being formed of a first material, selected to provide ventilation for a foot of a user; and the gaiter member, being formed of a second material different from the first material, selected to provide shielding of the stocking, the gaiter member overlapping a substantial portion of the stocking member, and having an axial cross section with a permanently closed perimeter, the cross section of the portion of the gaiter member having a closed perimeter having at least one of a substantially constant value and a value varying at a substantially constant rate, axially along the length of the gaiter.

2. The apparatus of claim 1, wherein the securement member permanently attaches the stocking member to the gaiter member.

3. The apparatus of claim 2, wherein the first material is formed to be breathable and extensible.

4. The apparatus of claim 3, wherein the second material is formed to be substantially inextensible.

5. The apparatus of claim 4, wherein the second material is formed to be substantially waterproof.

6. The apparatus of claim 5, wherein the second material is formed to be substantially breathable, for permitting vapors to pass therethrough.

7. The apparatus of claim 6, wherein the second material is formed to resist penetration by pointed objects.

8. The apparatus of claim 7, wherein the apparatus further comprises a draw member connected to the gaiter member for gathering the gaiter member together.

9. The apparatus of claim 8, wherein the gaiter member has a top end opening, a bottom end opening, a central portion therebetween, and a securement region, the draw member is positioned proximate a location along the length of the gaiter member, the location being selected from the top end opening, the bottom end opening, the central portion, and the securement region, the securement region being positioned proximate the securement member.

10. A method for protection of a bodily member of a user, the method comprising:

providing a stocking having a top portion for surrounding a leg of a user and a lower portion for surrounding a foot of a user;

providing a gaiter to secure to the stocking, and having a first collar, a second collar, and a barrier portion extending therebetween;

securing the first collar of the gaiter to the stocking;

placing the connected stocking and gaiter on the foot and lower leg of a user with the barrier portion in a first position with the second collar positioned above the first collar;

inserting the user's foot into the footwear; and folding the barrier portion into a second position with the second collar below the first collar, the barrier portion overlapping and circumscribing a substantial portion of the stocking.

11. The method of claim 10, further comprising securing the first collar sufficiently close to the bodily member of a user to resist entry of solid materials therebetween.

12. The method of claim 11, further comprising gathering the second collar sufficiently close to the footwear to resist entry of debris therebetween.

13. The method of claim 12, further comprising securing the second collar to the footwear with a fastener.

14. The method of claim 13, further comprising providing a substantially waterproof material for forming the barrier portion.

15. The method of claim 14, further comprising providing a breathable material for forming the barrier portion, the breathable material being configured to pass vapors therethrough.

16. The method of claim 15, wherein the barrier portion further comprises a securement region connectable to the stocking member, the method further comprising providing a draw for gathering a portion of the barrier portion, the barrier portion being selected from the first collar, the second collar, and the securement region.

17. The method of claim 16, wherein the stocking member is substantially permanently connected to the barrier portion.

18. The method of claim 17, further comprising positioning an end of an article of clothing inside the first collar, and positioned between the first collar and the bodily member of a user.

19. A method for protection of a bodily member of a user, the method comprising:

providing a stocking having an upper portion for surrounding the lower leg of a user and a lower portion for surrounding the foot of a user;

providing a gaiter having upper and lower portions conforming to the stocking and constructed of water resistant material;

providing a securement means securing the gaiter to the stocking and positioned between the upper portion and the lower portion of the gaiter;

inserting the foot of a user into the stocking;

inserting the user's foot, covered with both the stocking and gaiter, into footwear; and folding the upper portion of the gaiter to overlap the lower portion thereof.

20. An apparatus comprising:

a stocking having an upper portion for surrounding the lower leg of a user and a lower portion for surrounding the foot of a user;

a gaiter fitted over the stocking to conform thereto, having an axial cross-section having a permanently closed perimeter and constructed of substantially waterproof material; and a securement means securing the gaiter to the stocking, the securement means being positioned between the upper portion and the lower portion of the gaiter.

* * * * *